US006912440B2

(12) United States Patent
Tooley

(10) Patent No.: US 6,912,440 B2
(45) Date of Patent: Jun. 28, 2005

(54) CAMOUFLAGE COVERING AND METHOD OF MANUFACTURE OF THE CAMOUFLAGE COVERING

(76) Inventor: Kurt Tooley, 2304 - 18th St., Columbus, NE (US) 68601

( * ) Notice: Subject to any disclaimer, the term of this patent is extended or adjusted under 35 U.S.C. 154(b) by 83 days.

(21) Appl. No.: 10/407,655

(22) Filed: Apr. 4, 2003

(65) Prior Publication Data

US 2004/0194188 A1 Oct. 7, 2004

(51) Int. Cl.[7] ..... G06F 19/00; A41B 1/08

(52) U.S. Cl. ..... 700/132; 2/69; 2/900; 428/919

(58) Field of Search ..... 700/132; 2/69, 2/900, 1; 428/919, 195.1, 207

(56) References Cited

U.S. PATENT DOCUMENTS

| | | | | | |
|---|---|---|---|---|---|
| 1,817,871 | A | * | 8/1931 | Brandt | 428/211.1 |
| 4,494,245 | A | | 1/1985 | Burkhead et al. | 2/2 |
| 4,576,904 | A | * | 3/1986 | Anitole | 430/347 |
| 4,656,065 | A | | 4/1987 | Yacovella | 428/17 |
| 5,043,202 | A | * | 8/1991 | Knickerbocker | 428/195.1 |
| 5,274,848 | A | | 1/1994 | Shamblin | 2/69 |
| D358,928 | S | | 6/1995 | Slagle et al. | D2/743 |
| 5,727,253 | A | | 3/1998 | Wilkinson | 2/69 |
| 5,920,903 | A | | 7/1999 | Koehntop et al. | 2/69 |
| 5,924,131 | A | | 7/1999 | Wilkinson | 2/69 |
| D418,277 | S | | 1/2000 | Koehntop et al. | D2/743 |
| 6,061,828 | A | | 5/2000 | Josephs | 2/69 |
| 6,737,148 | B1 | * | 5/2004 | Smith | 428/131 |

FOREIGN PATENT DOCUMENTS

| | | |
|---|---|---|
| WO | WO 95/08435 | 3/1995 |

* cited by examiner

*Primary Examiner*—Peter Nerbun
(74) *Attorney, Agent, or Firm*—Michael L. Diaz

(57) ABSTRACT

A camouflage utilizing countercoloring, countershading, and disruptive coloration principles to provide concealment to a person or object. The method of manufacturing the camouflage covering includes photographing a form and obtaining imagery from the photographs. The imagery is then manipulated by photographic manipulative software to determine appropriate countershading for the camouflage covering. In addition, appropriate countercoloring and disruptive coloration is utilized upon indicia applied to the camouflage covering.

17 Claims, 2 Drawing Sheets

CAMOUFLAGE COVERING AND METHOD OF MANUFACTURE OF THE CAMOUFLAGE COVERING

BACKGROUND OF THE INVENTION

1. Technical Field of the Invention

This invention relates to camouflage and, more particularly, to a camouflage utilizing countershading, countercoloring and disruptive coloration camouflage techniques.

2. Description of Related Art

Currently, the most popular form of camouflage technique utilized is situational camouflage. Situational camouflage attempts to conceal an object or person with patterns resembling the surrounding vegetation in which the object or person is located. The basic theory is the better the resemblance to the local vegetation, the better the concealment of the object or person. With situational camouflage, there are no universal camouflage patterns which may be used in general for most environments. Rather, the more appropriate camouflage patterns depend on the local environment in which concealment by an individual or object is sought. There are patterns for broadleaf forest in the early and late seasons of the year, patterns for willows, wetlands, marshes, grasslands, evergreens, pear flats, and various other environments. Virtually all situational camouflages are optimized for concealment within specific environments. In addition, many of these camouflage patterns incorporate three-dimensional effects and photorealistic detail to provide greater emulation of the surrounding vegetation.

However, in addition to the fact that tailoring camouflage for every environment is expensive, the basic use of situational camouflage is flawed. It can be seen in nature that situational camouflage is not utilized by large predators. Large predators hunt by stealth, but still have not evolved camouflage patterns that look like the surrounding vegetation in which they hunt. In addition, all large predators that hunt by stealth have evolved camouflage patterns that, though they differ in the finest details, are exactly alike in principle. The forms of camouflage used by large predators are far superior to the situational camouflage used in existing camouflage. Additionally, the camouflage used by large predators is universal, or nearly universal, thus offering the best possible concealment in almost all environments. Presently, no camouflage exploits the crucial elements found in nature by large predators.

The leopard species provides an excellent example which contradicts the basic tenets of situational camouflage. Leopards live in many different habits from the rainforests, frigid mountains, and deserts. The leopard is found as far north as 50 degrees latitude to the southern tip of Africa. In order to survive, a leopard must kill by using stealth to approach its prey. When in close enough proximity to the prey, the leopard can launch an attack. Thus, the leopard's camouflage is particularly demanding and definitely a requisite for survival. It should be noted, that wherever the leopard is found around the world, the spots of the leopard never change. Thus, the leopard does not change to blend in with its environment as would be dictated by situational camouflage. Rather, the leopard has evolved to be invisible rather than look like the surrounding vegetation.

All of the great cats of the world, such as leopards, have developed camouflage which follows three basic principles. The first principle is that these large predators all are countershaded. Countershading conceals the shape of a countershaded form. Ordinarily, the way light strikes a form reveals its shape, contours, and orientation. Countershading counteracts the ordinary way that light strikes a form from above, thereby concealing the orientation, shape, contour and form of a countershaded form. Countershaded forms are invariably darker on top where the light is brighter, and lighter on the usually shadow-shrouded bottom. This subtle and sometimes dramatic shading conceals a predator by making it more uniformly lit, thereby making it seem less three-dimensional and more two-dimensional. A countershaded form appears flat, and is easily hidden, even in the thinnest of cover.

The second principle used by these large predators is countercoloring. Countercoloring counteracts the color composition of the light typically encountered by the predator and determines the color in which an animal is countershaded. Where countershading counteracts the intensity of light reflected on a countershaded form, countercoloring counteracts the color composition of the light reflected about the environment, thereby reducing the contrast of a countercolored form to its environment.

Three factors must be taken into account for countercoloring. First, in the open/under "normal" daylight, much of the light is blue light reflected around the blue sky. Second, yellow is the color that counteracts blue and reduces the contrast between a form countercolored in yellow under the sky in daylight. Third, the light filtering through vegetation is depleted in red light in proportion to the amount of vegetation because plants preferentially absorb red light for photosynthesis. Taken together, these three facts explain why animals that depend on stealth are countershaded in their particular colors. Yellow is the color needed to reduce the contrast of an object in normal, unfiltered daylight. Thus, the lion, which lives preferentially in the open and is exposed to the blue sky, is yellow in color. The heavier the vegetation in which an animal evolves and lives, the more depleted the prevailing light is in red and, thus, the redder (relative to a basic lion-like yellow which is the starting point needed to counteract strongly blue unfiltered daylight) an animal must be to compensate for the absorption of red light by the vegetation. This is why animals of the jungle such as tigers and jaguars are reddish brown or even orange. In addition, this explains why the leopard's color tends to be more yellow in more open habitats and tends to darken to rusty reddish brown and orange in jungle habitats. Also, this explains why there are no large predators that are green, even though almost all of them live in environments that are predominantly green for much of the year.

The third principle utilized by large predators is the use of disruptive coloration. Disruptive coloration further conceals the predator's shape by breaking it up with a contrasting pattern or shading. This effect may be quite subtle, such as the dark color on a lion's ear, or bold like a leopard's spots or a tiger's stripes. In each case, the disruptive patterns resemble the shadows cast by the vegetation through which the predator is likely to move while hunting.

Collectively, countershading, countercoloring, and disruptive coloration (CCD) are indispensable for camouflage success in big cats. CCD camouflage is currently not being used by man.

Although there are no known prior art teachings of a solution to the aforementioned deficiency and shortcoming such as that disclosed herein, prior art references that discuss subject matter that bears some relation to matters discussed herein are U.S. Pat. No. 4,656,065 to Yacovella (Yacovella), U.S. Pat. No. 5,920,903 to Koehntop et al. (Koehntop), U.S.

Pat. No. 5,924,131 to Wilkinson (Wilkinson), and U.S. Pat. No. 6,061,828 to Josephs (Josephs).

Yacovella discloses a camouflage cloth that mimics the rough bark of a tree. The camouflage combines the principles of mimicry, disruptive patterning, and shading. The disruptive patterning includes continuous bands of color that break up the form of the garment or the hunter wearing it. Shading is used to give the pattern a 3-dimensional effect. However, Yacovella does not teach or suggest the use of countershading to produce a 2-dimensional effect. In addition, Yacovella does not disclose the use of countercoloring.

Koehntop discloses a camouflaged apparel that resembles the coloration of a selected species of waterfowl. However, although Koehntop discloses the mimicry of an animal, Koehntop does not teach or suggest the use of CCD for camouflage.

Wilkinson discloses a process for designing camouflage clothing that uses software-enhanced photographic images of natural scenes to design and print a camouflage garment. However, Wilkinson does not teach or suggest the use of CCD for use in their camouflage garment.

Josephs discloses a camouflage garment and other items having a repeating camouflage pattern thereon. Certain embodiments of the invention utilize the principles of disruptive patterning and shading so that camouflaged items may blend in with surrounding features. However, Josephs does not employ CCD collectively within its camouflaged garments.

Thus, it would be a distinct advantage to employ the principles of CCD camouflage in concealing people and objects. It is an object of the present invention to provide methods in implementing and manufacturing CCD camouflage.

SUMMARY OF THE INVENTION

In one aspect, the present invention is a camouflage covering for concealment. The covering has indicia located on a surface of the covering. The indicia employs countershading. The covering is utilized to provide concealment in an outdoor environment.

In another aspect, the present invention is a method of manufacturing a camouflage covering employing principles of countershading. The method begins by photographing a form to obtain imagery of the form. Next, photographic negatives derived from the imagery of the form are produced. Indicia is designed for a camouflage covering by determining a countershade design from the negatives. The indicia is applied on the camouflage covering.

In still another aspect, the present invention is a camouflage garment for use by a person desiring concealment. The garment includes indicia located on a surface of the garment. The indicia employs countershading, countercoloring, and disruptive coloration to provide concealment to the person. The countershading provides countershading from direct sunlight exposure upon the person. The countershading is determined by photographing a human form and manipulating a resultant imagery by a manipulative photographic computer software.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

Figure 1:
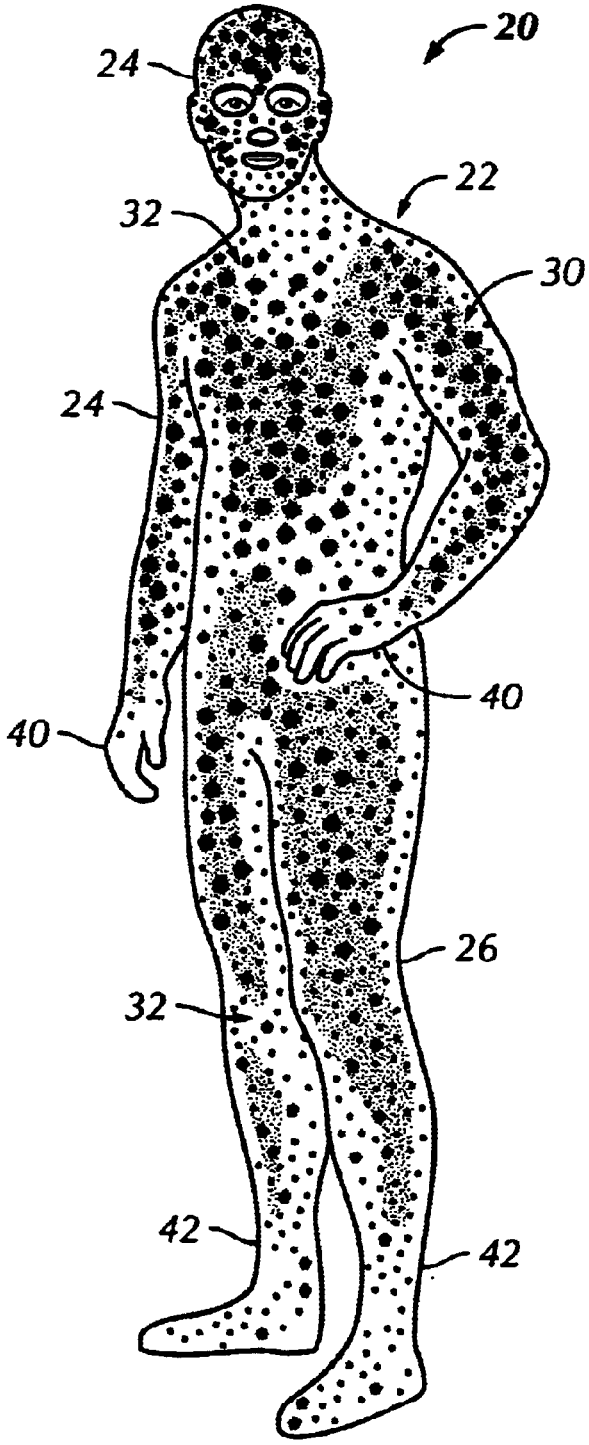
FIG. 1 is a perspective view of a man dressed in an exemplary camouflage system in the preferred embodiment of the present invention.

The present invention is a camouflage covering and a method of producing camouflage employing CCD camouflage principles. FIG. 1 is a perspective view of a man 20 dressed in an exemplary camouflage system 22 in the preferred embodiment of the present invention. The camouflage system includes a shirt 24, pants 26, a mask 28, gloves 40, and gaiters 42. Unlike existing camouflage garments, the camouflage system 22 utilizes the principles of countershading, countercoloring, and disruptive coloration (CCD).

The principles of CCD cannot be achieved by merely creating another camouflage pattern, transferring the pattern to cloth, and sewing pieces of cloth together to make the garment. An exact orientation of the pattern of each piece of cloth is indispensable to achieve true CCD camouflage. Each piece of the camouflage system 22 must be carefully constructed and oriented to achieve true CCD concealment for the CCD system to be constructed from dyed cloth. Specifically, the CCD system cannot be manufactured by simply sewing together pieces of cloth bearing the CCD camouflage pattern of a leopard or tiger. Emulating such patterns of other animals on a camouflage pattern do not capture the essence of the principles of CCD camouflage for human concealment. For example, the countershading of a tiger evolved to conceal a tiger's shape, not a man's shape. Human concealment through the use of CCD principles can only be achieved by utilizing countershading, countercoloring and disruptive coloration specialized for a human form. Considering first countercoloration within the camouflage system 22, as discussed above, predators simply do not vary much in color. Thus, the only reasonable choices for coloration of the camouflage system fall in a continuum from lion-like yellow to tiger-like rusty brown or orange, with the medium tones such as the base colors of a cougar or leopard providing an effective medium for near universal application. Therefore, in the preferred embodiment of the present invention, the camouflage system 22 is countercolored in the base colors of either leopards or cougars for maximum effectiveness and nearly universal utility.

Disruptive coloration is next considered for use in the camouflage system 22. Unlike countercoloring and countershading, there are no known universal laws governing disruptive coloration. Spots, stripes, and other patterns appear to work effectively. Extensive patterns may be seen in leopards, tigers, and jaguars while minimal patterns are seen in lions and cougars. Although the camouflage system 22 may utilize any number of acceptable ways, in the preferred embodiment of the present invention, the disruptive coloration of the leopard and/or cougar is utilized in the camouflage system.

The most difficult and unique principle utilized in the camouflage system 22 is the use of countershading. Countershading is crucial in implementing the principles of CCD in the camouflage system. As discussed above, countershading counteracts the tendency of daylight to reveal a shape of an object. Countershaded forms are darker on top where the light is stronger, and lighter where the light is weaker and typically white on the unlighted shadow-shrouded bottom. Countershading accounts for effects in both shade and direct sunlight. Typically, shaded portions are simply white, except for disruptive coloration native to typically shaded areas. Lighted portions darken in direct proportion to how well the subject is normally lighted. Thus, lighted portions are not uniformly colored like shaded portions, but smoothly shaded from dark to light in inverse proportion to the strength of the lighting, all of which varies over the complex curves of an animal's surface, an effect known to photographers as the "limb effect." The "limb effect" operates in much the same manner as film negatives. In practicality, countershading, and CCD camouflaging in general, is "film negative" or "color negative" camouflage.

Film negatives are light where the photographed scene is dark and dark where the photographed scene is light in precisely the same manner as a countershaded form. Thus, photographing the human form in various ways and from various angles in strong sunlight produces a blueprint for countershading the human form.

Unlighted portions of the anatomy are easily handled by photographing the human form in strong sunlight from various angles with a black and white film exposed and developed for extreme contrast. In the resulting negatives, areas that should be countershaded in white appear bright. However, in the preferred embodiment of the present invention, the human form is photographed, the film is exposed and developed as black and white film, and the negatives are then scanned. The negatives may then be manipulated utilizing conventional photographic computer software, such as Adobe Photoshop®. The areas on the negative that should be countershaded white are revealed as bright areas on the negatives by manipulating image levels or by scanning the negatives as pure black and white images, rather than grayscale images.

The use of manipulative photographic computer software programs, such as Adobe Photoshop®, permits the combining of images to produce composites that reveal areas to be countershaded white in "average" light. Average sunlight is the average effect of the light as the sun passes overhead from dawn to dusk. Countershading evolved to counter light from above as a whole, not the light of any particular time of the day. Therefore, no single photo can capture "average sunlight." A single photograph merely produces an approximation of how to countershade a form. In the preferred embodiment of the present invention, photographs are taken from all around a human form throughout the day. Then the average of the negatives from each vantage point is obtained via a computer and associated software by stacking the negatives (numbering n) and setting the opacity of each to 1/n. The result shows the areas to be countershaded white on average as the brightest areas on the composite of the negatives of photographs taken from each vantage point. This process may be repeated indefinitely to produce finer results. The result of the process is the determination of the areas on the countershaded human form which must be white as the brightest area on the composite negatives.

The tint and color intensity of the tint on the countershaded form is preferably, as explained above, in a narrow range of colors from lion-like yellow to tiger-like rust. The tawny base color of the mountain lion and the yellow-orange base color of the leopard are preferred. As the colors evolve on the garment utilized in the camouflage system 22 to minimize the contrast of the countershaded/countercolored form in sunlight, the human form being photographed should be photographed in sunlight and a shade of blue similar to the color of the sky.

Referring back to FIG. 1, the camouflage system 22 employs the principles of CCD to conceal the human form in natural outdoor environments. As illustrated, a top portion of the camouflage system 22 and the man 20 is countershaded by having darker portions 30 on top and lighter portions 32 on the lower part of the camouflage system 22. Additionally, disruptive coloration and countercoloring is utilized. The garment illustrated in the camouflage system 22 is exemplary only. Any garment may be utilized which produces a camouflage system employing the principles of CCD.

Figure 2:
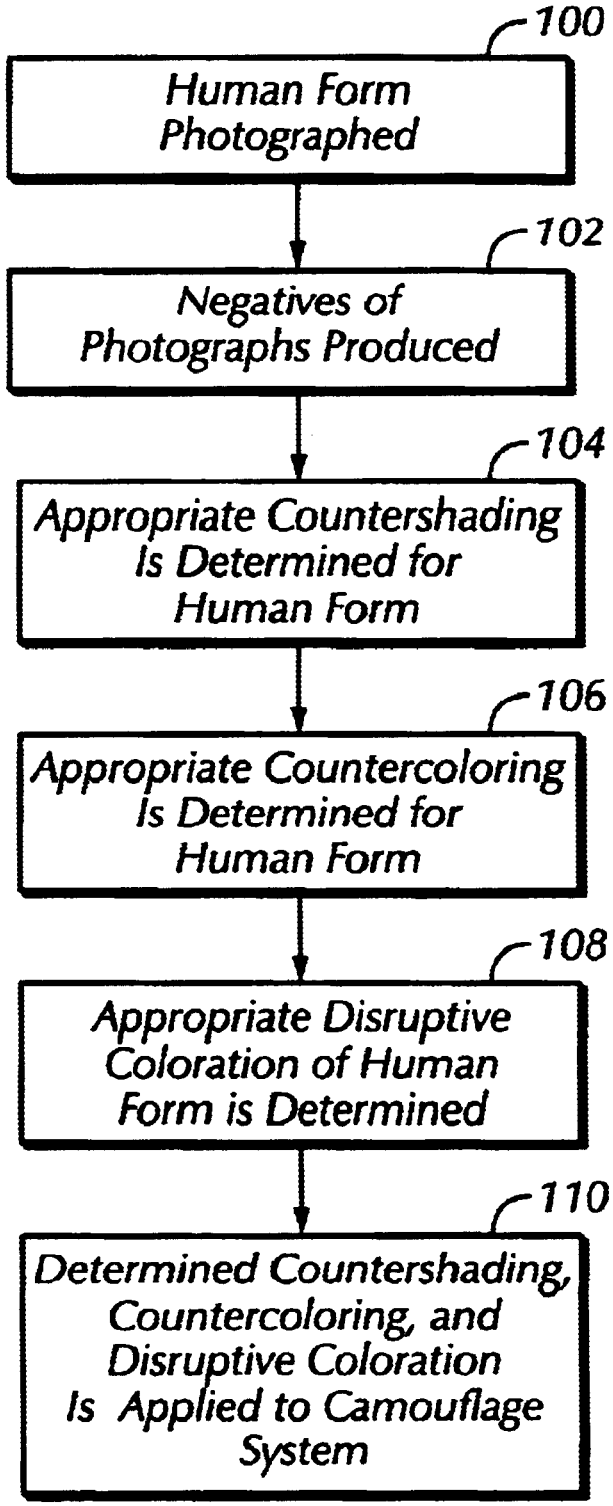
FIG. 2 is a flow chart outlining the steps for manufacturing the camouflage system of FIG. 1.

FIG. 2 is a flow chart outlining the steps for manufacturing the camouflage system 22 of FIG. 1. With reference to FIGS. 1 and 2, the steps of the method will now be explained. The method begins with step 100 where a human form is photographed. In the preferred embodiment of the present embodiment, several photographs are taken of the human form from various vantage positions. Additionally, the human form is photographed outside at various sun positions. Next, in step 102, negatives from the photographs created in step 100 are produced. In step 104, from the negatives, proper countershading is determined. Preferably, a manipulative photographic computer software program such as Adobe Photoshop® is utilized. The negatives, or images, are scanned into a computer for manipulation. Areas that should be countershaded white are revealed as bright areas while dark areas indicate darker shading. Additionally, iterative photographs taken in step 100 are used to produce composites to reveal areas to be countershaded white in "average light." The negatives or images may be stacked while setting the opacity of each to 1/n, where n is the number of negatives stacked. The results show the areas to be countershaded white on average as the brightest areas on the composite of the negatives. This process of stacking the negatives may be accomplished again several times for finer results.

The method then moves to step 106 where the countercoloring of the camouflage system 22 is determined. The preferred coloration of the camouflage system is most preferably within the colors used by the a lion (e.g., yellow) to a tiger (e.g., rusty brown or orange). These base colors are utilized for the camouflage system 22. Next, in step 108, disruptive coloration is determined for the camouflage system 22. As discussed above, any form of disruptive coloration may be employed. However, in the preferred embodiment of the present invention, the disruptive coloration of the leopard and/or the cougar is utilized.

The method then moves to step 110 where the collective determination of countershading, countercoloration, and disruptive coloration found in steps 100–108 are applied to the garments used in the camouflage system 22 by applying as an indicia upon the garments of the camouflage system. Preferably, the determined pattern is applied on conventionally dyed cloth. Once a prototype pattern is created, this resulting pattern is utilized as a blueprint for manufacturing a true CCD garment from conventionally manufactured dyed cloth.

Although present technology prefers the use of negatives from photographs, any imagery process may be utilized which can capture countershading of the human form. In addition, several variations of the camouflage system 22 may be utilized. For example, in order to comply with "Hunter Orange" laws which call for the use of the color orange for safety reasons, countercoloring and countershading in "Hunter Orange" may be used. In an alternate embodiment of the present invention, where cultures and/or laws prohibit the use of traditional camouflage, the camouflage system may use minimal disruptive coloration, such as a mountain lion.

Alternatively, the same methodology discussed above may be implemented by an artist utilizing an airbrush on a white garment to produce prototypes. The prototypes may then be disassembled by opening all seams and the resulting pieces. The resulting pattern of pieces may then be utilized as a blueprint for manufacturing a garment from conventionally manufactured dyed cloth with minimal waste and complications.

In addition, although the human form and camouflage garments are discussed above, it should be understood that the methodology may be applied to any object, such as a vehicle or equipment.

The present invention provides many advantages over existing camouflage garments. The present invention utilizes the proper use of CCD to created garments which provide the most effective camouflage and enhance human concealment. The camouflage system 22 may be used nearly universally. Rather than follow the tenets of situational camouflage garments, the present system does not require the change of patterns or their colors for different environments.

In addition, the present invention provides for a generality of the camouflage which is not present in existing camouflage. For all concealment sought in visible light, only the disruptive coloration may require change. For example, the leopard's spots may be eliminated, while a minimal lion-like or cougar-like disruptive coloration may be employed.

The present invention may also be utilized with military operations. For example, for use as night camouflage, countershading may be implemented in other colors (e.g., green) to maximize concealment from light-intensification (LI) devices. Existing LI devices see the world in shades of green. The present invention may utilize night camouflage by applying countershading to a covering to conceal the camouflaged object.

It is thus believed that the operation and construction of the present invention will be apparent from the foregoing description. While the method and system shown and described have been characterized as being preferred, it will be readily apparent that various changes and modifications could be made therein without departing from the scope of the invention as defined in the following claims.

What is claimed is:

1. A camouflage covering for concealment, said covering comprising:

a covering having indicia located on a surface of said covering, the indicia employing three-dimensional countershading, said covering providing concealment of a three-dimensional object in an outdoor environment, wherein the countershading is specific to the object being concealed.

2. The camouflage covering for concealment of claim 1 wherein the countershading includes countershading from direct sunlight exposed on the object.

3. The camouflage covering for concealment of claim 2 wherein the object is a person and the covering is a garment.

4. The camouflage covering for concealment of claim 3 wherein the countershading is specifically designed to countershade a shape of the person.

5. The camouflage covering for concealment of claim 1 wherein the countershading on said covering is obtained by photographing the object for creating imagery to determine a design providing countershading upon said covering.

6. The camouflage covering for concealment of claim 5 wherein computer manipulative photographic software manipulates the imagery to determine an appropriate countershading of the object.

7. The camouflage covering for concealment of claim 1 wherein the indicia employs countercoloring and disruptive coloration.

8. The camouflage covering for concealment of claim 7 wherein the countercoloring of said covering includes a base color of lion yellow.

9. The camouflage covering for concealment of claim 7 wherein the countercoloring of said covering includes a base color of rusty brown.

10. The camouflage covering for concealment of claim 7 wherein the countercoloring of said covering includes a base color of orange.

11. The camouflage covering for concealment of claim 7 wherein the disruptive coloration of said covering emulates the disruptive coloration of a large predator.

12. A method of manufacturing a camouflage covering employing principles of countershading, said method comprising the steps of:

photographing a form to obtain imagery of the form;

producing photographic negatives derived from the imagery of the form;

designing indicia for a camouflage covering by determining a three-dimensional countershade design from the negatives; and applying indicia on the camouflage covering.

13. The method of manufacturing a camouflage covering of claim 12 wherein said step of designing indicia for a camouflage covering includes utilizing photographic manipulation software to manipulate the negatives to providing countershading of the form.

14. The method of manufacturing a camouflage covering of claim 12 wherein the form is a human form.

15. The method of manufacturing a camouflage covering of claim 12 further comprising the steps of:

employing countercoloring on the camouflage covering; and employing disruptive coloration on the camouflage covering.

16. The method of manufacturing of a camouflage garment of claim 15 wherein said step of employing disruptive coloration includes emulating a large predator.

17. A camouflage garment for use by a person desiring concealment, said garment comprising:

a garment having indicia located on a surface of said garment, the indicia employing countercoloring, disruptive coloration and three-dimensional countershading;

the countershading providing countershading from direct sunlight exposure upon the person, whereby the countershading is determined by photographing a human form and manipulating a resultant imagery by a manipulative photographic computer software;

said garment being worn by the person to provide concealment in an outdoor environment.

* * * * *